United States Patent [19]

Nakamura et al.

[11] 4,122,044

[45] Oct. 24, 1978

[54] GRANULAR DETERGENT COMPOSITION

[75] Inventors: Masayoshi Nakamura, Koshigaya; Toshiaki Ogoshi, Funabashi; Mitsuyoshi Yazaki, Yachiyo, all of Japan

[73] Assignee: The Lion Fat and Oil Co., Ltd., Tokyo, Japan

[21] Appl. No.: 791,877

[22] Filed: Apr. 28, 1977

[30] Foreign Application Priority Data

May 18, 1976 [JP] Japan ..... 51/56829

[51] Int. Cl.[2] ..... C11D 1/12; C11D 3/08; C11D 3/10

[52] U.S. Cl. ..... 252/532; 252/533; 252/536; 252/551; 252/552; 252/555

[58] Field of Search ..... 252/135, 532, 536, 551, 252/555, 533, 552

[56] References Cited

U.S. PATENT DOCUMENTS

| | | | |
|---|---|---|---|
| 3,755,202 | 8/1973 | Bentley et al. | 252/536 |
| 3,892,680 | 7/1975 | Benjamin et al. | 252/532 |
| 3,915,903 | 10/1975 | Wise | 252/552 |
| 3,979,314 | 9/1976 | Child | 252/140 |
| 4,013,577 | 3/1977 | Wixon | 252/109 |
| 4,028,282 | 6/1977 | Okumura et al. | 252/537 |
| 4,061,603 | 12/1977 | Rubinfeld | 252/548 |

*Primary Examiner*—P.E. Willis, Jr.
*Attorney, Agent, or Firm*—Oblon, Fisher, Spivak, McClelland & Maier

[57] ABSTRACT

A granular detergent composition contains substantially no phosphate builder component but has excellent powdery characteristics. The granular detergent composition comprises (a) 20 to 35 wt.% of a surfactant comprising an α-olefinsulfonate and an alkyl ether sulfate at a ratio of the α-olefinsulfonate to the alkyl ether sulfate of 1 : 1 to 5 : 1 by weight; and (b) 40 to 70 wt.% of a builder comprising a carbonate and a silicate at a ratio of the carbonate to the silicate of 2 : 1 to 5 : 1 by weight.

8 Claims, No Drawings

GRANULAR DETERGENT COMPOSITION

BACKGROUND OF THE INVENTION

1. Field of the Invention

The present invention relates to a granular detergent composition. More particularly, it relates to a granular detergent composition having excellent powdery characteristics which does not substantially contain a phosphate.

2. Description of the Prior Art

Phosphates such as tripolyphosphate have excellent function as a builder component of a detergent composition.

It has been known to obtain a granular detergent composition having excellent powdery characteristics by incorporating the phosphate into the detergent composition.

However, the amount of the phosphate has been regulated from the viewpoint of preventing environmental pollution. Accordingly, various proposals have been found for non-phosphate detergent compositions which are combinations of anionic surfactants and alkali builder components of the carbonate and the silicate.

For example, in Japanese Unexamined Patent Publication No. 12426/1972, the non-phosphate detergent composition comprising the anionic surfactant and the alkali builder components of a mixture of the carbonate and the silicate.

However, the granular non-phosphate detergent compositions comprising the alkali builder components such as the carbonate or the silicate have relatively inferior powdery characteristics such as non-caking property, fluidity and particle strength, in comparison with those of the granular phosphate detergent compositions.

SUMMARY OF THE INVENTION

It is an object of the present invention to provide an improvement of a conventional granular non-phosphate detergent composition.

Another object of the present invention is to provide a granular non-phosphate detergent composition which has excellent powdery characteristics such as non-caking property, fluidity and particle strength.

The foregoing and other objects have been attained by providing a granular non-phosphate detergent composition which comprises (a) 20 to 35 wt.% of a surfactant comprising an α-olefinsulfonate and an alkyl ether sulfate at a ratio of the α-olefinsulfonate to the alkyl ether sulfate of 1:1 to 5:1 by weight; and (b) 40 to 70 wt.% of a builder comprising a carbonate and a silicate at a ratio of the carbonate to the silicate of 2:1 to 5:1 by weight.

DETAILED DESCRIPTION OF THE PREFERRED EMBODIMENTS

The granular detergent composition of the present invention comprises the specific weight ratio of the α-olefinsulfonate to the alkyl ether sulfate and the specific weight ratio of the carbonate to the silicate.

In accordance with the present invention, the α-olefinsulfonate (referring to as AOS) and the alkyl ether sulfate (referring to as AES) are used at a ratio of AOS to AES of 1:1 to 5:1 by weight.

When the ratio of AOS to AES is higher than the range, the dusting property is increased and the caking property is also increased even though the particle strength of the granular detergent composition is not substantially changed.

On the other hand, when the ratio of AOS to AES is lower than the range, the fluidity of the granular detergent composition is inferior and the caking property is increased.

In the granular detergent composition of the invention, total amount of the surfactants is in a range of 20 to 35 wt.%.

The caking property of the granular detergent composition is increased and the fluidity of the granular detergent composition is deteriorated depending upon increasing the total amount of the surfactants.

On the contrary, the total amount of the granular detergent composition needed for one washing operation is increased depending upon decreasing the total amount of the surfactants.

AOS used in the invention can be alkali metal salts of α-olefinsulfonic acid having 12 to 22 carbon atoms which are produced by the known process for sulfonating, neutralizing and hydrolyzing α-olefin. The AOS is usually a mixture of alkenesulfonate, hydroxyalkanesulfonate and a small amount of disulfonate and the mixture can be used without a separation of the components.

AES used in the invention can be produced by forming an adduct of ethyleneoxide of an average of 1 to 5 moles to a natural or synthetic alcohol having 9 to 18 carbon atoms and sulfating the resulting adduct and neutralizing it.

The neutralized product usually contain a small amount of alkylsulfate, however, it can be used as AES without a separation of the components. Thus, the amount of the alkylsulfate is preferably small from the viewpoint of the detergency.

The builder components used in the invention are the carbonate and the silicate at a ratio of the carbonate to the silicate of 2:1 to 5:1 by weight.

When the ratio of the carbonate to the silicate is higher than the range, the particle strength of the granular detergent composition is lowered to increase dusting caused by pulverizing the granules.

When the ratio of the carbonate to the silicate is lower than the range, the caking property of the granular detergent composition is increased to deteriorate the solubility of the particles.

Accordingly, it is necessary to determine the ratio of the carbonate to the silicate in said range. The total amount of the carbonate and the silicate that is the amount of the builder is in a range of 40 to 70 wt.%.

When the amount of the builder components is more or less than the range, it is difficult to impart excellent washing effect such as detergency and foaming and excellent physical properties of particles.

The carbonates used in the invention can be alkali metal carbonates, sesquicarbonate and bicarbonates, especially sodium salts thereof.

The silicates used in the invention can be the compounds having the formula $$M_2O \cdot xSiO_2$$

wherein M represents an alkali metal; $x$ represents 1.0 to 3.5 preferably 1.8 to 3.2. Sodium salts are especially preferably as that of the carbonates.

The granular detergent composition of the invention comprises the specific weight ratio of AOS to AES as the surfactants and the specific weight ratio of the carbonate to the silicate as the builder components and 20 to 35 wt.% of the total amount of AOS and AES and 40 to 70 wt.% of the total amount of the carbonate and the silicate. The other components may be incorporated in the granular detergent composition of the invention. For example, a foaming control agent such as soap; a redeposition preventing agent such as carboxymethyl cellulose, polyethyleneglycol, polyvinyl alcohol; fluorescent whitening dye, a coloring agent, perfume, etc. can be incorporated into the granular detergent composition.

It is possible to incorporate less than 25 wt.% of the other surfactants besides AOS and AES to the total amount of surfactants.

The other surfactants can be alkylsulfates, alkylbenzenesulfonates, polyoxyethylenealkyl ethers (alkyl group having 9 to 18 carbon atoms and adduct of ethyleneoxide having 1 to 20 average moles of ethyleneoxide) and ampholytic surfactants, etc.

It is also possible to incorporate the other type builders except the phosphate builders such as polycarbonates e.g. citrates, tartrates; cation-exchange water insoluble inorganic fine powder e.g. alminosilicates.

The granular detergent composition of the invention has an average particle diameter of 250 to 500 $\mu$. It is preferable to contain less than 2 wt.% of fine particles having a diameter of less than 50 $\mu$ without coarse particles having a diameter of more than 2000 $\mu$.

The granular detergent composition of the invention can be produced by spray-drying a slurry of the composition containing about 35 to 45 wt.% of water in the conventional method.

The granular detergent composition can be produced by preparing a detergent slurry containing all of the components of the composition and spray-drying the slurry.

The granular detergent composition of the invention prepared by a spray-drying method has an average particle diameter of 250 to 500 $\mu$ and an average bulk density of about 0.25 to 0.4.

When the bicarbonate or sesquicarbonate is added to the detergent slurry, a foaming or a formation of a water insoluble silicate is caused and accordingly, the bicarbonate or sesquicarbonate is preferably added to the spray-dried particles.

A perfume or a coloring agent is usually sprayed onto the dried particles as a liquid or it is incorporated in particles and is blended to the dried particles.

As stated above, the granular detergent compositions comprising AOS and AES at the specific weight ratio as the surfactant components and the carbonate and the silicate at the specific weight ratio as the builder components, has excellent physical property and imparts enough detergency foaming property even though a phosphate builder is not incorporated. Accordingly, the granular detergent composition does not cause significant dusting by pulverizing the granules in the production or during the storage in a carton and also does not cause the caking to lost fluidity thereof.

EXAMPLE

In order to describe the effect of the invention, each detergent slurry which comprises the components shown in Table 1 and about 40 wt.% of water was produced at 60° to 80° C. and then it was spray-dried by the conventional method to obtain each granular detergent composition containing about 8 wt.% of water.

The symbols in Table 1 designate the followings:

AOS: sodium $C_{16}$–$C_{18}$ $\alpha$-olefinsulfonate

AES: sodium $C_{11}$–$C_{15}$ alkyl ether sulfate (adduct of ethyleneoxide of about 3 moles)

AS: sodium $C_{11}$–$C_{15}$ alkylsulfate

LAS: sodium straight chain alkylbenzenesulfonate nonionic SAA: polyoxyethylenealkyl ether ($C_{11}$–$C_{15}$; adduct of ethyleneoxide of about 10 moles)

Sil: sodium silicate

Ash: sodium carbonate

Other additive: fluorescent whitening dye and redeposition preventing agent

Table 1

| | Surfactant components (%) | | | | | | component | |
|---|---|---|---|---|---|---|---|---|
| | AOS | AES | AS | LAS | nonionic SAA | Builder Sil | Ash | Others (%) |
| 1 | 25 | — | — | — | — | 15 | 50 | 2 |
| 2 | 22 | 3 | — | — | — | 15 | 50 | 2 |
| 3 | 20 | 5 | — | — | — | 15 | 50 | 2 |
| 4 | 15 | 10 | — | — | — | 15 | 50 | 2 |
| 5 | 12.5 | 12.5 | — | — | — | 15 | 50 | 2 |
| 6 | 10 | 15 | — | — | — | 15 | 50 | 2 |
| 7 | — | 25 | — | — | — | 35 | 30 | 2 |
| 8 | 20 | 10 | — | — | — | 30 | 30 | 2 |
| 9 | 20 | 10 | — | — | — | 18 | 42 | 2 |
| 10 | 20 | 10 | — | — | — | 11 | 49 | 2 |
| 11 | 20 | 10 | — | — | — | 7 | 53 | 2 |
| 12 | 16 | 4 | — | — | — | 20 | 50 | 2 |
| 13 | 20 | 15 | — | — | — | 16 | 39 | 2 |
| 14 | 15 | 7 | 7 | — | — | 15 | 46 | 2 |
| 15 | 12 | 10 | — | 4 | | 15 | 49 | 2 |
| 16 | 13 | 10 | — | — | 2 | 15 | 50 | 2 |

The caking properties, compressed properties, angles of repose, dusting properties, particle strengths and solubilities of the granule detergent compositions were measured by the following methods.

Caking property

Each granular detergent composition was filled in a carton (22 cm × 15.5 cm × 5.5 cm) and it was stored in a room at 35° C. in a relative humidity of 85% for 7 days and then, the carton was opened and the granular composition was carefully moved on a sieve and the seive was slowly vibrated. The ratio of the weight of the remained particles on the seive to the weight of the total particles was shown as percentage.

Compressed properties

Each granular detergent composition was filled in cylindrical column having an inner diameter of 10 cm and a height of 15 cm and it was compressed by a weight of 5 Kg to mold a test piece and the weight (Kg) needed for broken the test piece was measured.

Dusting property

Each granular detergent composition was flowed down from a carton at the place of a height of 20 cm. It was rated to be "remarkable" in the case of severe sneezing and to be "slight" in the case of substantially no sneezing.

Particle strength

Each granular detergent composition was filled in a carton (22 cm × 15.5 cm × 5.5 cm) and the carton was vertically shaken in an amplitude of 3 cm for 30 minutes and the decrease of depth (mm) of the granular detergent composition in the carton was measured.

Table 2

| | Caking property (%) | Compressed property (Kg) | Angle of repose | Dusting property | Particle strength (mm) | Solubility (sec.) |
|---|---|---|---|---|---|---|
| 1 | 90 | 2.5 | 45 | remarkable | 20 | |
| 2 | 90 | 2.5 | 45 | " | 20 | |
| 3 | 50 | 2 | 45 | slight | 20 | 30 - 90 |
| 4 | 60 | 2 | 45 | " | 20 | |
| 5 | 60 | 2 | 45 | " | 20 | 30 - 90 |
| 6 | 80 | 4 | 60 | " | 20 | |
| 7 | 100 | 5 | 70 | " | 15 | 300 |
| 8 | 100 | 1.5 | 45 | " | 15 | 30 - 90 |
| 9 | 50 | 2 | 45 | " | 20 | |
| 10 | 40 | 2 | 45 | " | 25 | |
| 11 | 40 | 3 | 45 | remarkable | 40 | |
| 12 | 40 | 2 | 40 | slight | 20 | |
| 13 | 50 | 2.5 | 45 | " | 20 | |
| 14 | 60 | 2.5 | 50 | " | 20 | |
| 15 | 60 | 2.5 | 50 | " | 20 | |
| 16 | 60 | 2.5 | 55 | " | 25 | |

As it is clear from Table 2, in accordance with the invention, the granular detergent compositions having excellent physical properties can be attained.

What is claimed is:

1. A phosphate-free granular detergent composition which comprises (a) 20 to 35 wt.% of a surfactant comprising a $C_{12}$–$C_{22}$-α-olefinsulfonate and a $C_9$–$C_{18}$-alkyl ether sulfate at a ratio of the α-olefinsulfonate to the alkyl ether sulfate of 1:1 to 5:1 by weight; and (b) 40 to 70 wt.% of a builder comprising a water soluble carbonate and a water soluble silicate at a ratio of the carbonate to the silicate of 2:1 to 5:1 by weight.

2. A granular detergent composition according to claim 1 wherein said α-olefinsulfonate is an alkali metal salt of α-olefinsulfonic acid having 12 to 22 carbon atoms and said alkyl ether sulfate is an alkali metal salt of an alkyl ether sulfate having a $C_9$–$C_{18}$ alkyl group and an adduct of ethyleneoxide of 1 to 5 moles.

3. A granular detergent composition according to claim 1 wherein the carbonate is an alkali metal carbonate, sesquicarbonate or bicarbonate, and the silicate is an alkali metal silicate having the formula $M_2O.xSiO_2$ wherein M represents an alkali metal; $x$ represents 1.0 to 3.5.

4. A granular detergent composition according to claim 1 wherein the α-olefinsulfonate is a mixture of alkenylsulfonate and hydroxyalkanesulfonate produced by sulfonating, neutralizing, and hydrolyzing α-olefin and the alkyl ether sulfate is a mixture produced by forming an adduct of ethyleneoxide of an average of 1 to 5 moles to a natural or synthetic alcohol having 9 to 18 carbon atoms and sulfating the resulting adduct and neutralizing it.

5. A granular detergent composition according to claim 1 wherein the particle size of the granular detergent composition is an average of 250 to 500 μ.

6. A granular detergent composition according to claim 1 wherein the α-olefinsulfonate and the alkyl ether sulfate are mutually combined with the builder components of the carbonate and the silicate in each particle, produced by spray-drying a mixture thereof.

7. A granular detergent composition according to claim 6 wherein the particles have an average apparent density of 0.25 to 0.4 and an average particle size of 250 to 500 μ.

8. A granular detergent composition according to claim 1 wherein a part of the builder components is blended to the particles containing the α-olefinsulfonate, the alkyl ether sulfate, the carbonate and the silicate.

* * * * *